US009856546B2

(12) United States Patent
Fischer et al.

(10) Patent No.: US 9,856,546 B2
(45) Date of Patent: Jan. 2, 2018

(54) METAL POWDER

(75) Inventors: Jürgen Fischer, Langelsheim (DE); Aloys Eiling, Bochum (DE); Frank Schrumpf, Goslar (DE); Stefan Zimmermann, Laufenburg (DE); Peter Thienel, Vienenburg (DE); Roland Scholl, Gürwihl (DE)

(73) Assignee: H. C. Starck GmbH, Goslar (DE)

( * ) Notice: Subject to any disclaimer, the term of this patent is extended or adjusted under 35 U.S.C. 154(b) by 1616 days.

(21) Appl. No.: 12/441,938

(22) PCT Filed: Sep. 21, 2007

(86) PCT No.: PCT/EP2007/060058

§ 371 (c)(1),
(2), (4) Date: Oct. 1, 2009

(87) PCT Pub. No.: WO2008/034902

PCT Pub. Date: Mar. 27, 2008

(65) Prior Publication Data

US 2010/0047622 A1 Feb. 25, 2010

(30) Foreign Application Priority Data

Sep. 22, 2006 (DE) ..... 10 2006 045 481

(51) Int. Cl.

| | |
|---|---|
| ***B23B 9/00*** | (2006.01) |
| ***C22C 29/02*** | (2006.01) |
| ***C23C 4/06*** | (2016.01) |

(52) U.S. Cl.

CPC ..... *C22C 29/02* (2013.01); *C23C 4/06* (2013.01); *B22F 2998/00* (2013.01); *C22C 2204/00* (2013.01)

(58) Field of Classification Search

USPC ..... 419/14

See application file for complete search history.

(56) References Cited

U.S. PATENT DOCUMENTS

| | | | | |
|---|---|---|---|---|
| 3,254,970 | A | 6/1966 | Dittrich et al. | |
| 3,993,446 | A * | 11/1976 | Okawa | 75/240 |
| 4,681,734 | A * | 7/1987 | Simm et al. | 419/9 |
| 5,358,545 | A * | 10/1994 | Nagro | 75/236 |
| 6,554,885 | B1 | 4/2003 | Mende et al. | |
| 6,641,640 | B1 | 11/2003 | Hesse et al. | |
| 7,282,079 | B2 | 10/2007 | Mizuno et al. | |
| 2007/0199410 | A1 | 8/2007 | Scholl et al. | |
| 2009/0283331 | A1 | 11/2009 | Heath | |
| 2010/0009089 | A1 | 1/2010 | Junod et al. | |
| 2010/0047622 | A1 | 2/2010 | Fischer et al. | |

FOREIGN PATENT DOCUMENTS

| | | | | |
|---|---|---|---|---|
| DE | 1446207 | | | 2/1969 |
| DE | 3015709 | A1 | | 10/1981 |
| DE | 19822663 | A1 | | 12/1999 |
| DE | 19855422 | A1 | | 6/2000 |
| DE | 102004062295 | A1 | | 9/2005 |
| DE | 102006045481 | B3 | | 3/2008 |
| EP | 1788104 | A1 | | 5/2007 |
| EP | 1857204 | A1 | | 11/2007 |
| GB | 669588 | | | 4/1952 |
| GB | 2214523 | A | | 9/1989 |
| JP | 2001081526 | A | | 3/2001 |
| JP | 2004019490 | A | * | 1/2004 |
| JP | 2005068515 | A | | 3/2005 |
| JP | 2005320557 | A | | 11/2005 |
| WO | WO-2004/104248 | A2 | | 12/2004 |
| WO | WO-2004/104250 | A1 | | 12/2004 |
| WO | WO-2005/007327 | A2 | | 1/2005 |

OTHER PUBLICATIONS

Richard Knight and Ronald W. Smith, "Thermal Spray Forming of Materials," ASM Handbook, vol. 7 (1998), pp. 408-419.*

ASTM G 32-98: "Standard Test Method for Cavitation Erosion Using Vibratory Apparatus", ASTM International, pp. 1-14 (Dec. 1998).

ASTM C 1070-01: "Standard Test Method for Determining Particle Size Distribution of Alumina of Quartz by Laser Scattering", ASTM International, pp. 1-3 (Nov. 2001).

ASTM G 65-04: "Standard Test Method for Measuring Abrasion Using the Dry Sand/Rubber Wheel Apparatus", ASTM International, pp. 1-12 (Nov. 2004).

ASTM B 117-07a: "Standard Practice for Operating Salt Spray (Fog) Apparatus", ASTM International, pp. 1-10 (Jan. 2008).

* cited by examiner

*Primary Examiner* — Jessee Roe
*Assistant Examiner* — Christopher Kessler
(74) *Attorney, Agent, or Firm* — Drinker Biddle & Reath LLP

(57) ABSTRACT

The invention provides for a cermet powder containing
- 75-90% by weight of at least one hard material powder,
- from 10 to 25% by weight of one or more matrix metal powders and
- up to 3% by weight of at least one modifier, wherein the matrix metal powder or powders contain
- from 0 to 38% by weight of cobalt,
- from 0 to 38% by weight of nickel,
- from 0 to 20% by weight of aluminum,
- from 0 to 90% by weight of iron and
- from 10 to 35% by weight of chromium and the sum of the contents of iron and chromium is in the range from 10 to 95% by weight and the sum of the contents of cobalt, nickel and iron is in the range from 65 to 95% by weight. The invention also relates to a cermet and a process to make the cermet containing the cermet powder and shaped article coated with the cermet powder and a process to make the shaped article.

16 Claims, 2 Drawing Sheets

METAL POWDER

CROSS-REFERENCE TO RELATED APPLICATIONS

This application is a national stage application (under 35 U.S.C. §371) of PCT/EP2007/060058, filed Sep. 21, 2007, which claims benefit of German application 10 2006 045481.2, filed Sep. 22, 2006.

BACKGROUND OF THE INVENTION

The invention relates to novel powder mixtures, in particular cermet powders, for the surface coating of metal substrates by thermal spraying processes such as plasma spraying or high-velocity flame spraying (HVOF), flame spraying, electric arc spraying, laser spraying or application welding, for example the PTA process.

Such powders comprise at least one finely divided hard material powder such as WC, $Cr_3C_2$, TiC, $B_4C$, TiCN, $Mo_2C$, etc., and a finely divided metal or alloy matrix powder. Hard material powder and matrix powder are intensively mixed, usually in the presence of a solution of an organic binder, if appropriate with comilling, atomized, dried, sieved and subsequently heated under a hydrogen-containing atmosphere to remove the organic binder and produce a sintered bond so that relatively large agglomerates having a particle size of from 10 to 100 μm are formed.

DE-B2-1446207 discloses a flame spraying powder which contains metal carbides as hard material and from 10 to 45% of aluminum and nickel as metal.

As matrix metal powders, cobalt- and nickel-containing powders, in particular, have become established in the industry.

BRIEF SUMMARY OF THE INVENTION

It is a first object of the invention to reduce the use of cobalt further since cobalt has become a raw material for which demand exceeds supply because of its widespread use.

A further object of the invention is to provide low-cobalt cermet coatings which compared to customary Co—Cr matrix alloys have comparable or increased abrasion resistance and cavitation resistance.

Another object of the invention is to increase the corrosion resistance of cermet coatings, in particular to reduce the solubility of matrix metals from the coatings.

The invention provides cermet powders containing 75-90% by weight of at least one hard material powder and from 10 to 25% by weight of one or more matrix metal powders and also up to 3% by weight of modifiers, wherein the matrix metal powder or powders contain
from 0 to 38% by weight of cobalt,
from 0 to 38% by weight of nickel,
from 0 to 20% by weight of aluminum,
from 0 to 90% by weight of iron and
from 10 to 35% by weight of chromium and
the sum of the contents of iron and chromium is in the range from 10 to 95% by weight and the sum of the contents of cobalt, nickel and iron is in the range from 65 to 95% by weight.

DETAILED DESCRIPTION OF THE INVENTION

Figure 1:
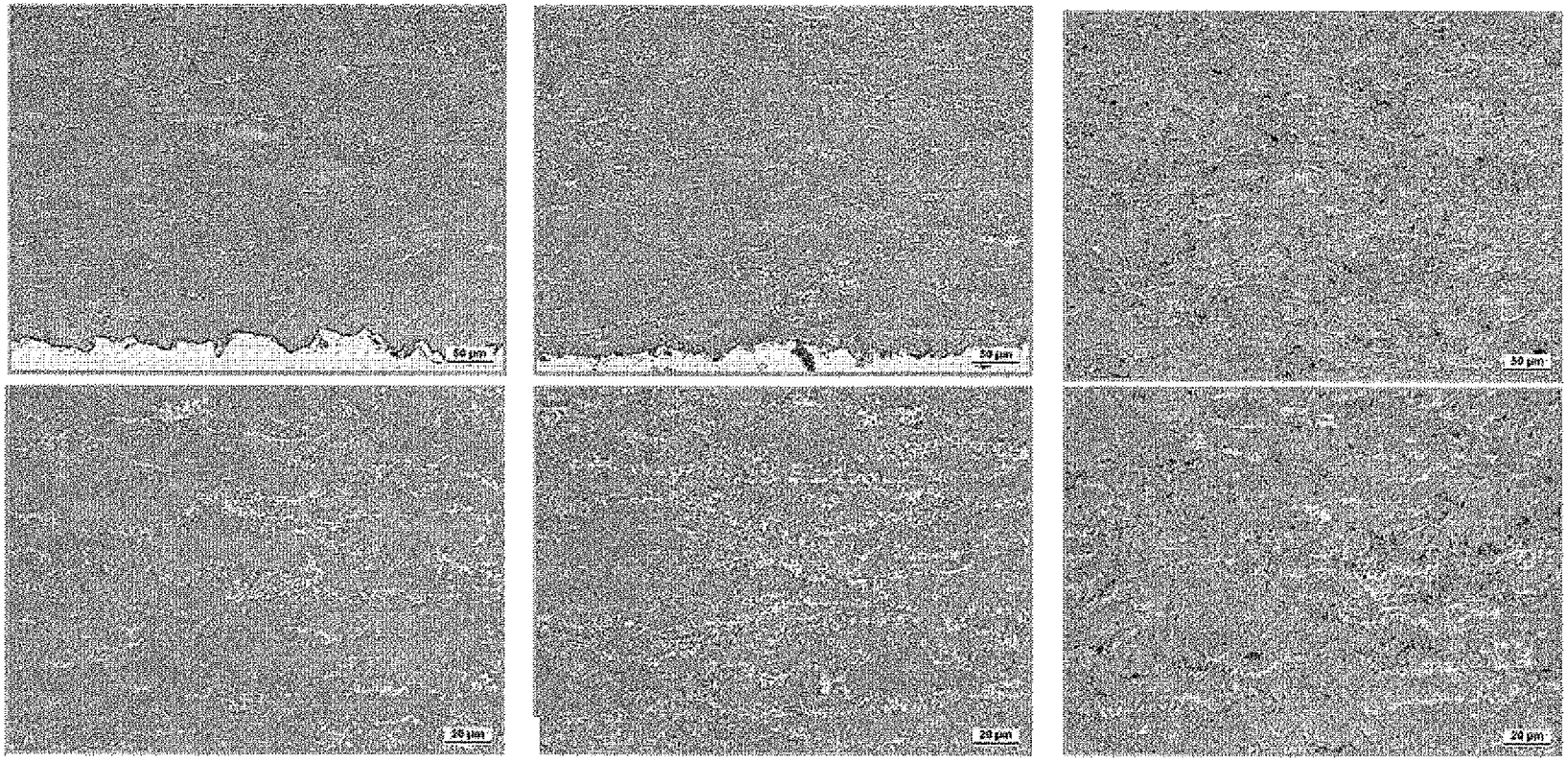
FIG. 1*a* illustrates optional micrograph of the microstructure of the coatings produced using the powder from example 1.
FIG. 1*b* illustrates optional micrograph of the microstructure of the coatings produced using the powder from example 2.
FIG. 1*c* illustrates optional micrograph of the microstructure of the coatings produced using the powder from example 3.

The invention provides for a cermet powder comprising
75-90% by weight of at least one hard material powder,
from 10 to 25% by weight of one or more matrix metal powders and
up to 3% by weight of at least one modifier,
wherein the matrix metal powder or powders contain
from 0 to 38% by weight of cobalt,
from 0 to 38% by weight of nickel,
from 0 to 20% by weight of aluminum,
from 0 to 90% by weight of iron and
from 10 to 35% by weight of chromium and
the sum of the contents of iron and chromium is in the range from 10 to 95% by weight and the sum of the contents of cobalt, nickel and iron is in the range from 65 to 95% by weight.

Advantageous cermet powders are powders which contain 75-90% by weight of at least one hard material powder and from 10 to 25% by weight of one or more matrix metal powders and also up to 3% by weight of modifiers, wherein the matrix metal powder or powders contain up to 38% by weight of cobalt, up to 38% by weight of nickel, up to 20% by weight of aluminum, up to 90% by weight, advantageously up to 75% by weight, of iron and from 20 to 35% by weight of chromium and the sum of the contents of iron and chromium is in the range from 25 to 95% by weight and the sum of the contents of cobalt, nickel and iron is in the range from 65 to 95% by weight, advantageously from 65 to 75% by weight.

Particularly advantageous cermet powders are powders as claimed in claim 1 containing 75-90% by weight of at least one hard material powder and from 10 to 25% by weight of one or more matrix metal powders and also up to 3% by weight of modifiers, wherein the matrix metal powder or powders contain from 0 to 38% by weight of cobalt,
from 0 to 38% by weight of nickel,
from 0 to 20% by weight of aluminum,
from 0 to 75% by weight of iron and
from 20 to 35% by weight of chromium and
the sum of the contents of iron and chromium is in the range from 25 to 95% by weight and the sum of the contents of cobalt, nickel and iron is in the range from 65 to 75% by weight.

A further embodiment of the invention provides cermet powders containing 75-90% by weight of at least one hard material powder and from 10 to 25% by weight of one or more matrix metal powders and also up to 3% by weight of modifiers, wherein the matrix metal powder or powders contain
from 0 to 38% by weight of cobalt,
from 0 to 38% by weight of nickel,
from 0 to 20% by weight of aluminum,
from 30 to 90% by weight of iron, advantageously
from 30 to 75% by weight of iron, and
from 10 to 35% by weight of chromium and the sum of the contents of iron and chromium is in the range from 10 to 95% by weight, advantageously from 60 to 95% by weight, and the sum of the contents of cobalt, nickel and iron is in the range from 65 to 95% by weight.

In preferred cermet powders according to the invention, the matrix metals nickel and cobalt are present in a weight ratio of at least 2:3, more preferably in a weight ratio of 1:1, particularly preferably in a weight ratio of 3:2.

Particularly preferred cermet powders according to the invention are cobalt-free. Further preferred cermet powders are cobalt- and nickel-free.

More preferred, in particular low-cobalt or cobalt-free, cermet powders according to the invention have a content of iron in the matrix metal of at least 30% by weight, with the sum of the contents of iron and chromium in the matrix powder or powders being at least 60% by weight. In such cermet powders, the matrix metal powder or powders contain from 0 to 10% by weight of cobalt,
from 0 to 38% by weight of nickel,
from 0 to 20% by weight of aluminum,
from 30 to 90% by weight of iron, advantageously
from 30 to 75% by weight of iron, and
from 10 to 35% by weight of chromium.

In cermet powders of the invention, in particular cobalt-free cermet powders of the invention, the ratio of the sum of the contents of chromium and aluminum to the sum of the contents of iron, nickel and chromium in parts by weight is preferably from 1:2.2 to 1:3.7, particularly preferably from 1:2.7 to 1:3.6.

A preferred composition can have from 20 to 26% by weight of chromium, from 64 to 72% by weight of iron and from 5 to 16% by weight of aluminum.

Possible hard material powders are the customary hard material constituents of cermet coatings, e.g. WC, $Cr_3C_2$, VC, TiC, $B_4C$, TiCN, SiC, TaC, NbC, $Mo_2C$ and mixtures thereof. Preference is given to WC and $Cr_3C_2$, in particular WC.

The matrix powders can be produced in a manner known per se by atomization of metal or alloy or part alloy melts. When part alloy powders or metal powders which have not been prealloyed are used, alloying occurs during use (for example during spray application) of the cermet powders.

Preferred cobalt, nickel and/or iron part alloy matrix powders are obtained by chemical precipitation by reaction of appropriate salts with excess oxalic acid, drying and thermal treatment as described in DE 198 22 663 A1 or U.S. Pat. No. 6,554,885 B1, with chromium being mixed in as metal powder.

Possible modifiers are, in particular, steel substrate upgrading elements such as Mo, Nb, Si, W, Ta and/or V.

The matrix metal or matrix alloy powders are preferably free of further constituents apart from tolerable impurities.

The present invention also provides a cermet which has the above-described composition and also a shaped article coated with such a cermet.

To produce these cermet powders, the hard material powder or powders and the matrix powder or powders and also modifiers having, if appropriate, different average particle sizes which should, however, in each case be less than 10 μm in diameter are slurried in a manner known per se in an aqueous solution of an organic binder and homogenized by means of mix-milling in a ball mill, an attritor or a stirred vessel and the suspension is atomized in a spray dryer, with the water evaporating from the sprayed droplets. The resulting powder agglomerate is converted into a powder having an intended particle size by means of classification processes (sieving, sifting) and the organic binder of the agglomerate is released into a hydrogen-containing atmosphere by sintering at a temperature of up to about 1300° C., in particular from 1100° C. to 1300° C. The resulting sinter cake is converted back into powder having the intended particle size range by physical treatment (crushing, milling, sieving, sifting).

A cermet according to the invention can be obtained by pressing and sintering of the cermet powders described or else by thermal spraying, i.e. by means of a thermal spraying process such as high-velocity flame spraying, cold gas spraying, plasma spraying or similar processes. The present invention therefore likewise provides a process for producing a cermet or an article having the above-described composition, which comprises the steps:

providing a powder as claimed in one or more of claims 1 to 11 in a form or preparation which is suitable for thermal spraying;
carrying out a thermal spraying process using this powder;
obtaining the cermet or the article.

The present invention therefore likewise provides a process for producing a cermet or an article having the above-described composition, which comprises the steps:

providing a powder as claimed in one or more of claims 1 to 11;
shaping the powder under pressure to give a green body;
heating the green body to give the cermet or the article.

EXAMPLES 1 to 7

A tungsten carbide powder having a particle size of 0.9 μm determined by FSSS, a carbon content of 6.1% by weight and a content of free carbon of 0.05% by weight was used in each case.

The matrix powder 1 (table 1) of examples 1 to 5 having the composition indicated there was produced by chemical precipitation using a method analogous to example 2 of DE 198 22 663 A1. The particle size was 1.4-2.2 μm FSSS at a specific surface area determined by the BET method of 1.8-2.6 $m^2/g$. The matrix powder 2 of examples 1 to 3 is an electrolytically produced powder having a particle size D50 of 3.1 μm (laser light scattering).

The matrix metal powder of examples 6 and 7 was obtained by atomization of an alloy melt of Fe, Cr and Al. The particle size D90 was 10.8 and 10.2 μm, respectively (laser light scattering).

About 50 kg of cermet powder composed of WC and matrix alloys of the composition shown in table 1 were introduced into an initial charge of 10 l of water containing about 1% of polyvinyl alcohol (PVA, Shin-Etsu, GP05) as binder and about 0.5% of Nalco (Deutsche Nalco GmbH) as wetting agent and homogenized by means of a ball mill, the homogenized suspension was atomized in a commercial spray dryer and the water was evaporated from the spray droplets. The agglomerated powder obtained in this way is subjected to a thermal treatment and the bond is thereby converted into a sintered bond. The sintered cake obtained in this way is converted into powder in the intended particle size range by crushing, milling, sieving and sifting. The carbon content, the average particle size determined by laser light scattering, the particle size distribution and the bulk density of the cermet powders are reported in table 1.

TABLE 1

| | | Example No. | | | | | | |
|---|---|---|---|---|---|---|---|---|
| | | 1 | 2 | 3 | 4 | 5 | 6 | 7 |
| WC | % by weight | 86 | 86 | 86 | 88 | 83 | 88 | 88 |
| Matrix powder 1 | % by weight | 10 | 10 | 10 | 12 | 17 | 12 | 12 |
| Co content | Parts by weight | 5 | 1 | 0 | 2.4 | 0 | 0 | 0 |
| Ni content | Parts by weight | 5 | 2 | 5 | 4.8 | 3.1 | 0 | 0 |
| Fe content | Parts by weight | 0 | 7 | 5 | 4.8 | 13.9 | 8.5 | 8 |
| Cr content | Parts by weight | 0 | 0 | 0 | 0 | 0 | 2.75 | 3 |
| Al content | Parts by weight | 0 | 0 | 0 | 0 | 0 | 0.75 | 1 |
| Matrix powder 2: Cr | % by weight | 4 | 4 | 4 | 0 | 0 | 0 | 0 |
| Cermet powder: | | | | | | | | |
| C content | % by weight | 5.49 | 5.4 | 5.5 | 5.43 | 5.15 | 5.78 | 5.82 |
| Sintering temperature | ° C. | 1140 | 1150 | 1160 | 1150 | 1150 | 1140 | 1140 |
| Average particle size | μm | 35.3 | 34.4 | 33.6 | 35.8 | 36.4 | 28.1 | 26.5 |
| D90% | μm | 57.1 | 56.7 | 55.4 | 57.9 | 57.7 | 44.8 | 43.2 |
| D50% | μm | 33.7 | 32.5 | 31.6 | 34.1 | 35.1 | 25.7 | 24.6 |
| D10% | μm | 18.4 | 17.3 | 17.0 | 18.3 | 19.5 | 13.6 | 13.0 |
| Bulk density | $g/cm^3$ | 4.22 | 4.11 | 4.15 | 3.93 | 3.95 | 3.92 | 3.96 |

Coatings on building steel ST37 were produced from the powders by means of high-velocity flame spraying (HVOF system Diamond Jet Hydrid 2600).

Table 2 reports the properties of the coatings.

Figure 2:
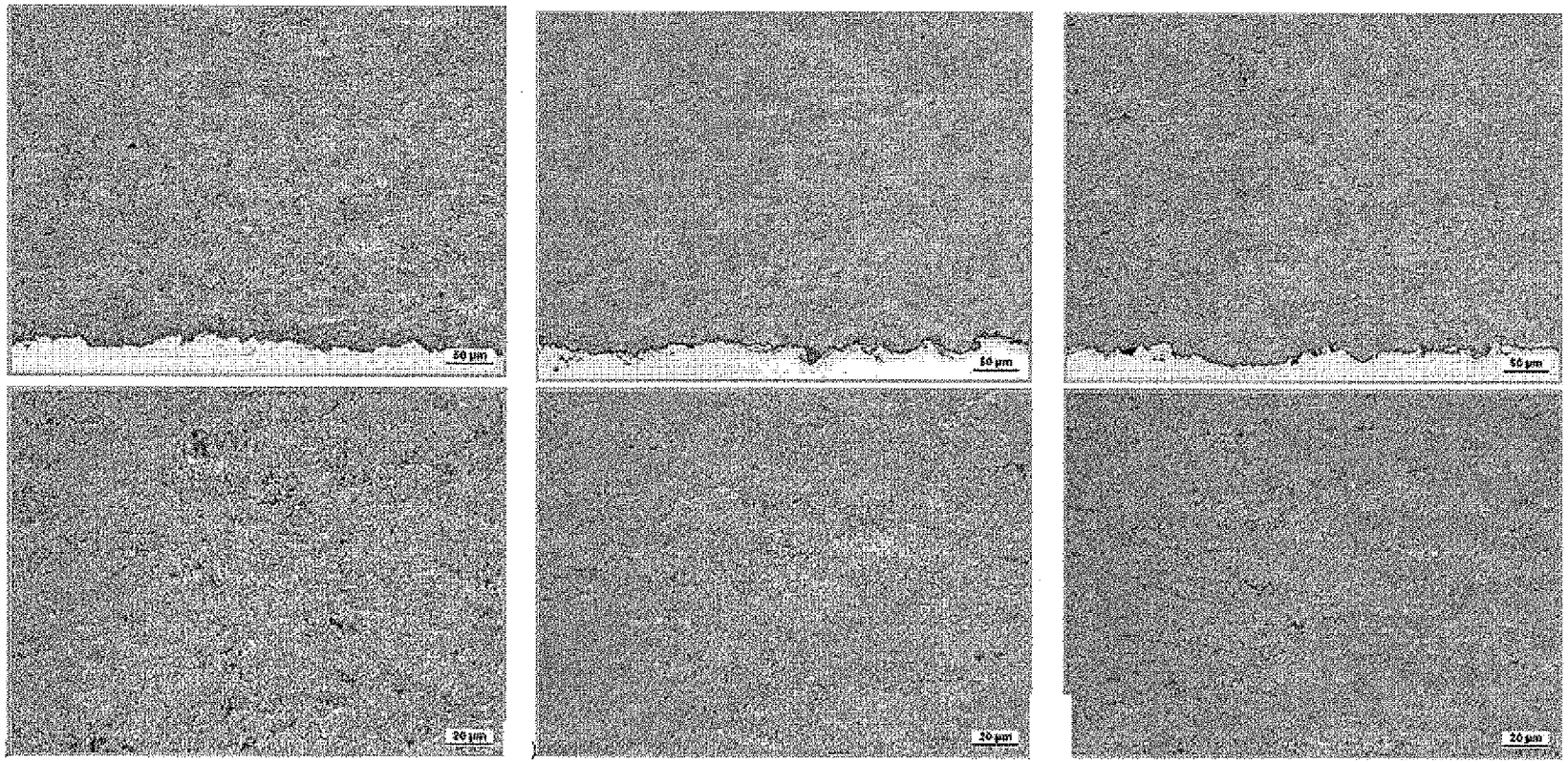
FIG. 2*a* illustrates optical micrographs of the microstructure of the coatings produced using the powder from example 7 and using as the spray parameter the standard.
FIG. 2*b* illustrates optical micrographs of the microstructure of the coatings produced using the powder from example 7 and using as the spray parameter, cold and fast.
FIG. 2*c* illustrates optical micrographs of the microstructure of the coatings produced using the powder from example 7 and using as the spray parameter, hot and slow.

FIG. 1 shows optical micrographs of the microstructure of the coatings produced using the powders from examples 1 (FIG. 1*a*)), 2 (FIG. 1*b*)) and 3 (FIG. 1*c*)). FIG. 2 shows optical micrographs of the microstructure of the coatings produced using the powder from example 7 and using the spray parameters "standard" (FIG. 2*a*)), "cold and fast" (FIG. 2*b*)) and "hot and slow" (FIG. 2*c*)), respectively.

TABLE 2

| | | Powder from example | | | | |
|---|---|---|---|---|---|---|
| | | 1 | 2 | 3 | 6 | 7 |
| Surface roughness | | | | | | |
| Ra | μm | 3.9 | 3.33 | 3.88 | 3.74 | 3.65 |
| Rz | μm | 22.44 | 21.05 | 22.49 | 21.52 | 20.52 |
| Hardness HV 0.3[1)] | | 1388 ± 82 | 1275 ± 117 | 1329 ± 90 | 1386 ± 112 | 1393 ± 139 |
| Cavitation rate[2)] | mg/h | 3.3 ± 0.5 | 4.7 ± 0.9 | 4.7 ± 0.7 | 6.1 ± 1.8 | 6.3 ± 2.2 |
| Wear[3)] | mg | 33.5 | 33.5 | 23.3 | 18.1 | 17.8 |
| O content | % by weight | 0.30 | 0.47 | 0.37 | 0.68 | 0.75 |
| C content | % by weight | 4.42 | 4.23 | 4.29 | 4.68 | 4.70 |
| C loss | % by weight | 19 | 22 | 22 | 19 | 19 |
| Corrosion resistance/ salt spray test | | ++ | ++ | + | +++ | +++ |

[1)] in accordance with DIN EN ISO 6507

[2)] in accordance with ASTM G 32

[3)] in accordance with ASTM G65

The invention claimed is:

1. An agglomerated and sintered cermet spraying powder having a particle size of from 10 to 100 μm comprising 75-90% by weight of at least one hard material powder having a particle size of less than 10 μm, from 10 to 25% by weight of one or more matrix metal powders having a particle size of less than 10 μm and up to 3% by weight of at least one modifier, wherein the matrix metal powder or powders contain from 0 to 20% by weight of aluminum, from 0 to 90% by weight of iron and from 10 to 35% by weight of chromium and the sum of the contents of iron and chromium in the matrix powder or powders being at least 60% by weight and wherein the powder is an agglomerated and sintered spray powder and wherein the matrix powder or powders is/are cobalt- and nickel-free.

2. The agglomerated and sintered cermet spraying powder as claimed in claim 1, which comprises from 75-90% by weight of at least one hard material powder, from 10 to 25% by weight of one or more matrix metal powders and up to 3% by weight of modifiers, wherein the matrix metal powder or powders contain from 0 to 20% by weight of aluminum, from 0 to 75% by weight of iron and from 20 to 35% by weight of chromium and the sum of the contents of iron and chromium is in the range from 60 to 95% by weight.

3. The agglomerated and sintered cermet spraying powder as claimed in claim 1, wherein the matrix metal powder contains from 0 to 75% by weight of iron.

4. The agglomerated and sintered cermet spraying powder as claimed in claim 1, wherein the content of iron in the matrix powder or powders is at least 30% by weight.

5. The agglomerated and sintered cermet spraying powder as claimed in claim 1, wherein the ratio of the sum of the contents of chromium and aluminum to the sum of the contents of iron and chromium in parts by weight is from 1:2.2 to 1:3.7.

6. The agglomerated and sintered cermet spraying powder as claimed in claim 1, wherein the matrix powder has the composition: from 20 to 26% by weight of chromium, from 64 to 72% by weight of iron and from 5 to 16% by weight of aluminum.

7. The agglomerated and sintered cermet spraying powder as claimed in claim 1, wherein the hard material powder is a powder selected from the group consisting of WC, $Cr_3C_2$, VC, $Mo_2C$ and mixtures thereof.

8. The agglomerated and sintered cermet spraying powder as claimed in claim 1, wherein the modifier is selected from the group consisting of Mo, Nb, Si, W, Ta, V and mixtures thereof.

9. A process for coating a surface with comprises thermal spray coating the surface with the powder as claimed in claim 1.

10. A process for producing a cermet which comprises providing the powder according to claim 1 in a form or preparation which is suitable for thermal spraying;

carrying out a thermal spraying process using this powder; and obtaining the cermet.

11. A process for producing a shaped article which comprises providing the powder according to claim 1 in a form or preparation which is suitable for thermal spraying;

carrying out a thermal spraying process using this powder; and obtaining the article.

12. A process for producing a cermet which comprises providing the powder according to claim 1;

shaping the powder under pressure to give a green body; and heating the green body to give the cermet.

13. A cermet having the powder as claimed in claim 1.

14. A shaped article which has a coating comprising the cermet as claimed in claim 13.

15. A process for producing the article as claimed in claim 14, which comprises the steps:

providing the powder according to claim 1;

shaping the powder under pressure to give a green body; and heating the green body to give the article.

16. An agglomerated and sintered cermet spraying powder having a particle size of from 10 to 100 μm consisting essentially of 75-90% by weight of at least one hard material powder having a particle size of less than 10 μm, from 10 to 25% by weight of one or more matrix metal powders having a particle size of less than 10 μm and up to 3% by weight of at least one modifier, wherein the matrix metal powder or powders contain from 0 to 20% by weight of aluminum, from 0 to 90% by weight of iron and from 10 to 35% by weight of chromium and the sum of the contents of iron and chromium in the matrix powder or powders being at least 60% by weight and wherein the powder is an agglomerated and sintered spray powder and wherein the matrix powder or powders is/are nickel and colbalt-free.

* * * * *